United States Patent [19]

Davis

[11] Patent Number: 4,626,050

[45] Date of Patent: Dec. 2, 1986

[54] KIT BOX HAVING A HOUSING AND FLEXIBLE BINS

[76] Inventor: William H. Davis, 5705 Twineing, Dallas, Tex. 75227

[21] Appl. No.: 772,424

[22] Filed: Sep. 4, 1985

[51] Int. Cl.[4] ..... A47B 81/00; B65D 21/02

[52] U.S. Cl. ..... 312/293; 206/328; 206/499; 211/71; 220/20

[58] Field of Search ..... 206/223, 328, 334, 332, 206/577, 499; 220/20, 23.86, 408; 312/107, 107.5, 108, 114, 126, 128, 198, 201, 203, 257 R, 263–265, 293, 117; 211/71

[56] References Cited

U.S. PATENT DOCUMENTS

| | | | |
|---|---|---|---|
| 3,552,817 | 1/1971 | Marcolongo | 312/107 |
| 3,719,272 | 3/1973 | Bodine et al. | 206/328 |
| 3,851,936 | 12/1974 | Muller | 312/108 |
| 4,192,439 | 3/1980 | Segal | 220/20 |
| 4,262,605 | 4/1981 | Sokol | 312/107 |
| 4,293,070 | 10/1981 | Ohlbach | 206/328 |

FOREIGN PATENT DOCUMENTS

| | | | |
|---|---|---|---|
| 0460706 | 6/1928 | Fed. Rep. of Germany | 220/20 |
| 2135429 | 2/1973 | Fed. Rep. of Germany | 312/107 R |

*Primary Examiner*—William Price
*Assistant Examiner*—Jimmy G. Foster
*Attorney, Agent, or Firm*—Jay M. Cantor

[57] ABSTRACT

The disclosure relates to a kit box formed of electrostatically protective material comprising a housing of rigid material and a plurality of bins, preferably without sides formed of flexible material wherein the bins are stacked one atop the other and are releasable secured in the housing. The securing apparatus is a combination of mating locking elements in the housing and on the outer surface of the bins as well as the compressive force applied to the resilient bin structure by the housing wherein the bins are retained under compression.

20 Claims, 5 Drawing Figures

FIG. 4
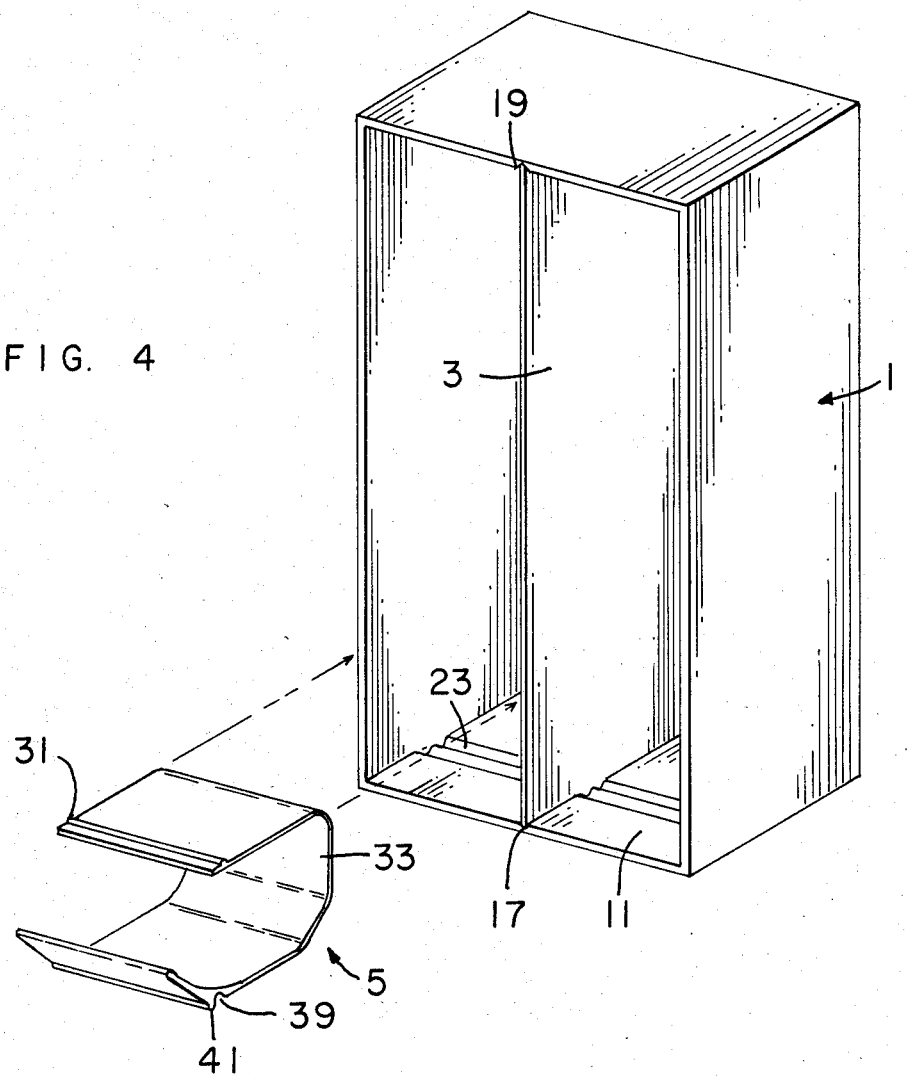
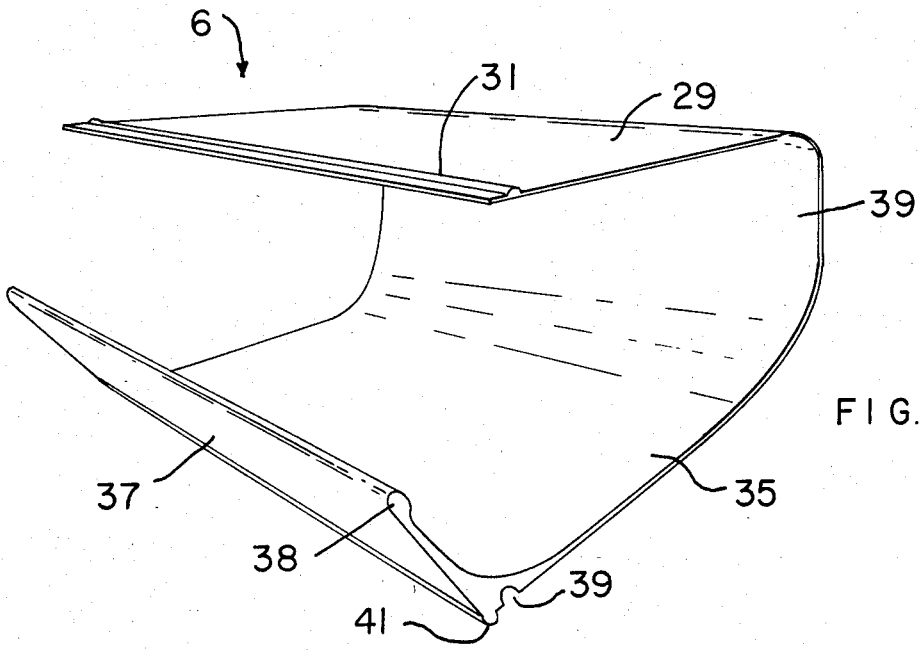
FIG. 3

KIT BOX HAVING A HOUSING AND FLEXIBLE BINS

BACKGROUND OF THE INVENTION

1. Field of the Invention

This invention relates to a kit box and, more specifically, to such a box which is free of or minimizes electrostatic discharge therein.

2. Brief Description of the Prior Art

Typically, the assembly of electronic systems requires that numerous parts be arranged and be available to an assembly operator in a manner which is conducive to minimizing assembly time by providing for easy identification, part segregation and control of the materials used by the assembler. This operation of organizing material is known as "kitting" and the part containers used in this operation are referred to as "kit boxes".

Standard prior art kit boxes are typically compartmented cardboard boxes or metal/plastic containing a plurality of stacked drawers. Such kit boxes have operated successfully in the past. However, as technology has advanced, and as components of circuits have become more miniaturized, damage to components due to electrostatic discharge has become a major problem in the manufacturing process which problem did not exist in the prior art wherein only larger components were utilized. A necessary measure required to minimize electrostatic discharge is to remove static generators from the work area. Thus, the prior art kit boxes, which were generally produced from cardboard and standard plastic have caused problems in that both materials are static generators. For this reason, one prior art kit box, composed of large compartmented cardboard boxes in the form of bins, while being of convenient size to accommodate typical quantities of most components used in assembly and being readily accessible by even relatively large hands and providing space for easy identification of the parts therein, has been a static generator. Also, due to its extremely light weight, it has been unstable, has suffered the normal wear attributed to cardboard materials and has not been conducive to efficient manufacture in electrostatically protective material embodiments. Electrostatically protective material is defined herein as any material which, as a result of its molecular composition, acts to reduce, retard, or eliminate damage due to electrostatic discharge. This definition includes, but is not limited to, anti-static, static dissipative and electrically conductive materials.

A further prior art configuration is composed of a metal or plastic box containing plastic drawers therein. This type of kit box is not conducive to assembly operation because the bin sizes will accommodate only a limited volume of components and the drawers must be physically opened for access to the parts therein. In addition, part identification is restricted. Therefore, even though this prior art kit box can be formed from electrostatically protective material, it still does not provide the desired features required for electronic assembly.

Further prior art devices have included stackable bins where one bin is stacked on top of the other without a housing. While such bins have a great deal of application due to their flexibility, such bins are easily knocked over when stacked due to a lack of a housing therefore. In addition, without a housing or lid, protection from electrostatic discharge and physical damage is reduced.

A fourth prior art kit box utilizes flexible bins which are coated with an electrostatically protective material. The user folds the material and uses tab locks to form a bin. This type of kit box has been difficult to produce with a consistancy of size and shape and has therefore found little acceptance in the industry. Furthermore, the conductive coating deteriorates with normal wear.

It can be seen that what is required is a kit box which can be formed utilizing an electrostatically protective material, preferrably a moldable plastic, to minimize electrostatic discharge, and which can be efficiently manufactured to provide a kit box having easy accessibility to parts therein, constant segregation of the different parts and easy identification of the parts in each box to the assembly operator during the assembly operation.

SUMMARY OF THE INVENTION

In accordance with the present invention, there is provided a kit box which overcomes the problems of the prior art as is enumerated hereinabove and which provides the easy access, segregation and identification required for use by an assembly operator and, in addition, substantially minimizes electrostatic discharge by use of electrostatically conductive material and yet can be formed and assembled simply and inexpensively.

Briefly, in accordance with the present invention, there is provided a housing having divider grooves therein for receiving a central divider. The housing also includes locking grooves at the top and bottom perpendicular to the divider groove which act as locks for bin tabs on the bins. The bins are formed of flexible electrostatically protective material and are of somewhat rectangular parallelepipeds having top, bottom, front and back walls and no side walls, the front wall being shorter than its opposite wall and extending outwardly from the bin to provide an opening thereinto. The bin bottom has a downward slope from rear to front to cause retention of parts at the front of the bin for easy access thereto. Each bin includes, at the junction of the bottom and the front wall a lower locking tab and a locking groove adjacent thereto, a further upper locking tab being formed at the front portion of the top wall and lid.

The kit box is assembled by placing the divider in the divider grooves of the housing and moving it rearwardly therein until the divider rests in a divider groove on the rear wall of the box with a retainer flange on the divider resting against the rear wall of the box. A first bin is then disposed between the divider and a side wall of the box in such manner that the lower locking tab fits into one of the plurality of locking grooves formed in the base of the housing. A further bin is then stacked over the first bin in such manner that the upper locking tab of the first bin rest in the locking groove of the second bin, this operation being continued on both sides of the divider until the entire space has been filed with bins. It can be seen that, due to the flexibility of the bins, there will be a downward force placed on all of the bins on each side of the divider when the housing is filled with bins, thereby locking the bins in the housing. It is also apparent that a bin can be removed by moving the free ends thereof together to withdraw the upper and lower locking tabs from the locking grooves in which they rest and moving that bin forward out of the housing. Since the housing as well as the bins are formed of an electrostatically protective material, it can be seen that electrostatic discharge in the kit box is minimized. Installation of the lid provides further electrostatic discharge protection as well as additional physical protection of content during transport. In addition, it can be seen that each of the bins is readily accessable by the hand of an assembly operator and that there is also adequate room on the bin for a labelling surface which is readily visible to the operator.

BRIEF DESCRIPTION OF THE DRAWINGS

FIG. 3 is a perspective view of a bin in accordance with the present invention;

FIG. 4 is a perspective view of the arrangement of FIG. 2 with divider in place and a first bin about to be disposed in the kit box.

DESCRIPTION OF THE PREFERRED EMBODIMENT

Figure 1:
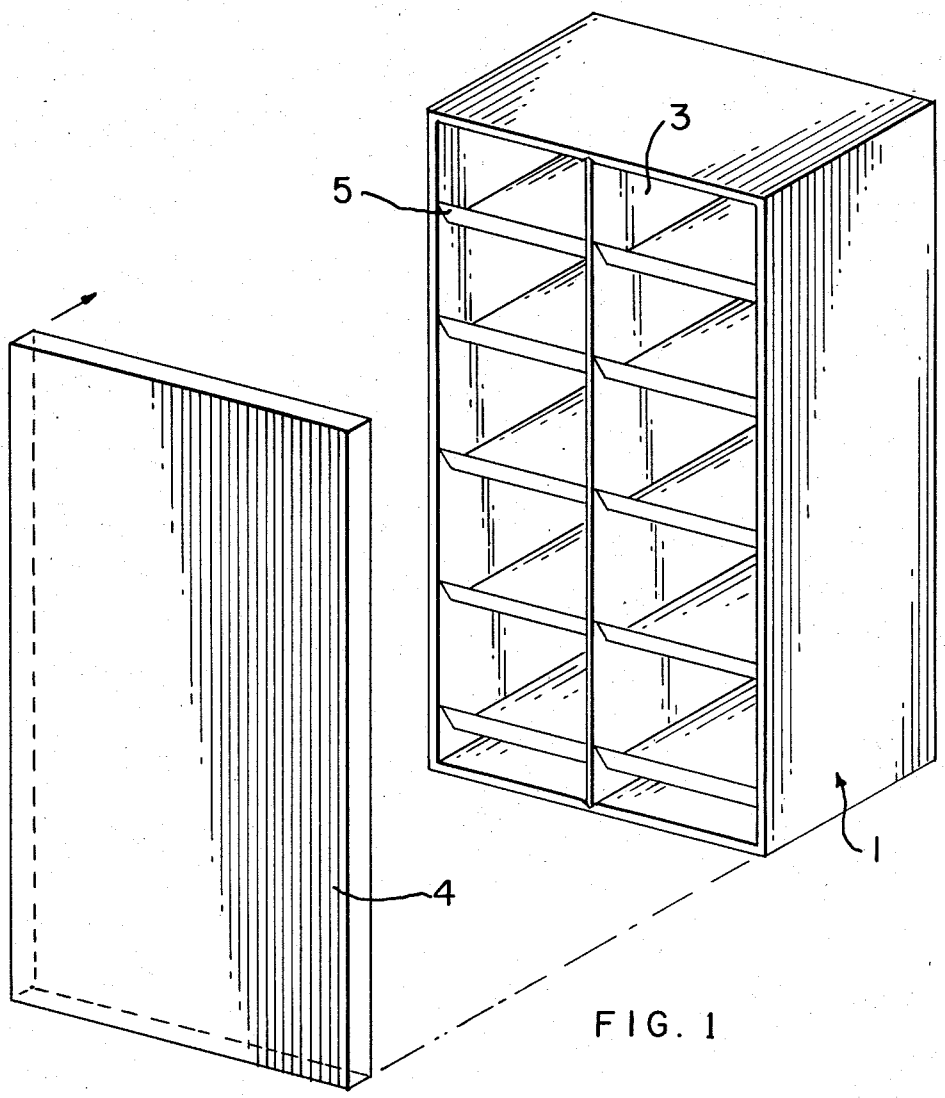
FIG. 1 is a perspective view of a kit box in accordance with the present invention.

Referring now to FIG. 1, there is shown a perspective view of a kit box in accordance with the present invention, the kit box includes a housing 1 which is formed of an electrostatically protective material. Within the housing 1 is a divider 3 which is disposed in grooves in the housing as will be explained hereinbelow. A plurality of bins 5 are disposed in the housing 1 on both sides of the divider 3. A lid 4 is installed over the bin openings for physical and electrostatic discharge protection of the bin contents. The housing, divider and lid are also formed of electrostatically protective material such as anti-static, static dissipative or conductive plastics.

Figure 2:
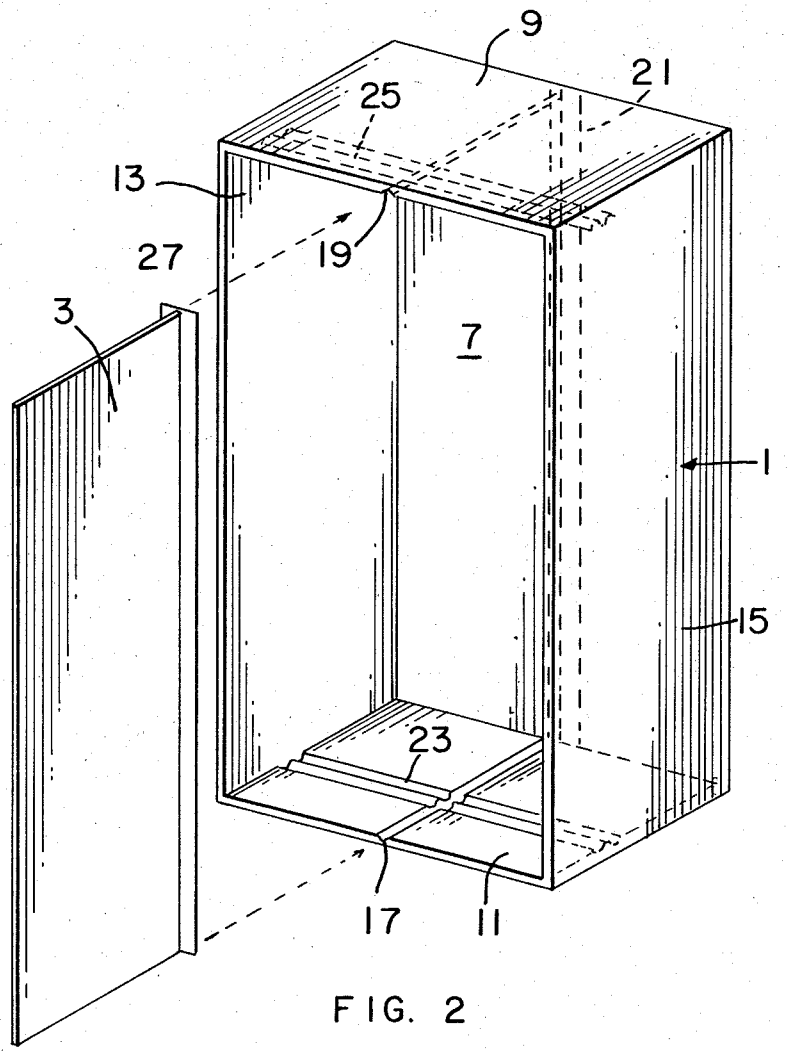
FIG. 2 is an exploded view of an unassembled kit box without bins in accordance with the present invention.

Referring now to FIG. 2, there is shown the housing 1 which includes a rear wall 7, a top wall 9, a bottom 11 and side walls 13 and 15. A pair of divider grooves 17 and 19 is formed in the bottom 11 and top 9 and extend from the front to the back of the housing normal to the rear wall 7. These grooves are designed to receive the divider 3 therein. The rear wall includes a groove 21 therein for receiving the retainer flange 27 of the divider 3, the groove 21 being coplanar with the grooves 17 and 19. Also disposed in the bottom 11 and the top 9 are sets of dual locking grooves 23 and 25 which are perpendicular to the divider grooves 17 and 19 and are utilized for locking of the bin locking tabs therein as will be explained hereinbelow. This retainer flange 27 extends outwardly on both sides of the divider 3 and is secured in place by the rear walls of the bins which will be installed as will be described hereinbelow and therefore becomes immovable with the bins in place. The divider 3 also serves as the inside bulkhead for the bins which will be described hereinbelow.

Referring now to FIG. 3, there is shown a perspective view of a typical bin 5, it being noted that a plurality of such identical bins 5 will be stacked one atop the other on each side of the divider as shown in FIG. 1. The bin 5 is formed of an electrostatically protective material, preferrably a moldable electrostatically protective plastic and has flexible walls. The bin includes a top wall portion 29 having an upper locking tab 31 integral with the front edge thereof, a rear wall portion 33 which is somewhat rounded and extends to mate with the top wall portion 29, the rear wall portion 33 also extending to mate with a bottom wall portion 35. The bottom wall portion 35 is concave so that parts resting thereon will move toward the front of the bin for easy access thereto. The bottom wall 35 extends to a front wall portion 37 which can be more rigid than the remainder of the bin 5 and which extends outwardly from the bin and provides an opening to the bin between its free end and the free end of the top wall 29. The internal upper surface 38 of the front wall 37 is rounded to provide a gripping aid for small parts, this being an enhancement over prior art designs. At the junction of the front and bottom wall portions 35 and 37 is a locking groove 39 which is utilized to lock with the upper locking tab 31 of the bin 5 therebelow. There is also provided adjacent the locking groove 39 a lower locking tab 41 which is utilized on the lowermost bin 5 to nest in the forwardmost of the dual grooves 23 in the bottom 11 of the housing 1. Because the housing and central divider provide inner and outer bulkheads, manufacturing processes are simplified and the bins can be either injection or extrusion molded. Though the preferred embodiment of the bin does not include side walls, it is readily apparent that partial side walls can be utilized as long as the side walls do not restrict the movement of the upper and lower locking tabs. For example, a side wall secured to the bottom of the bin and not to the top can be utilized and would not restrict the movement of the bin top relative to the bin bottom.

Figure 5:
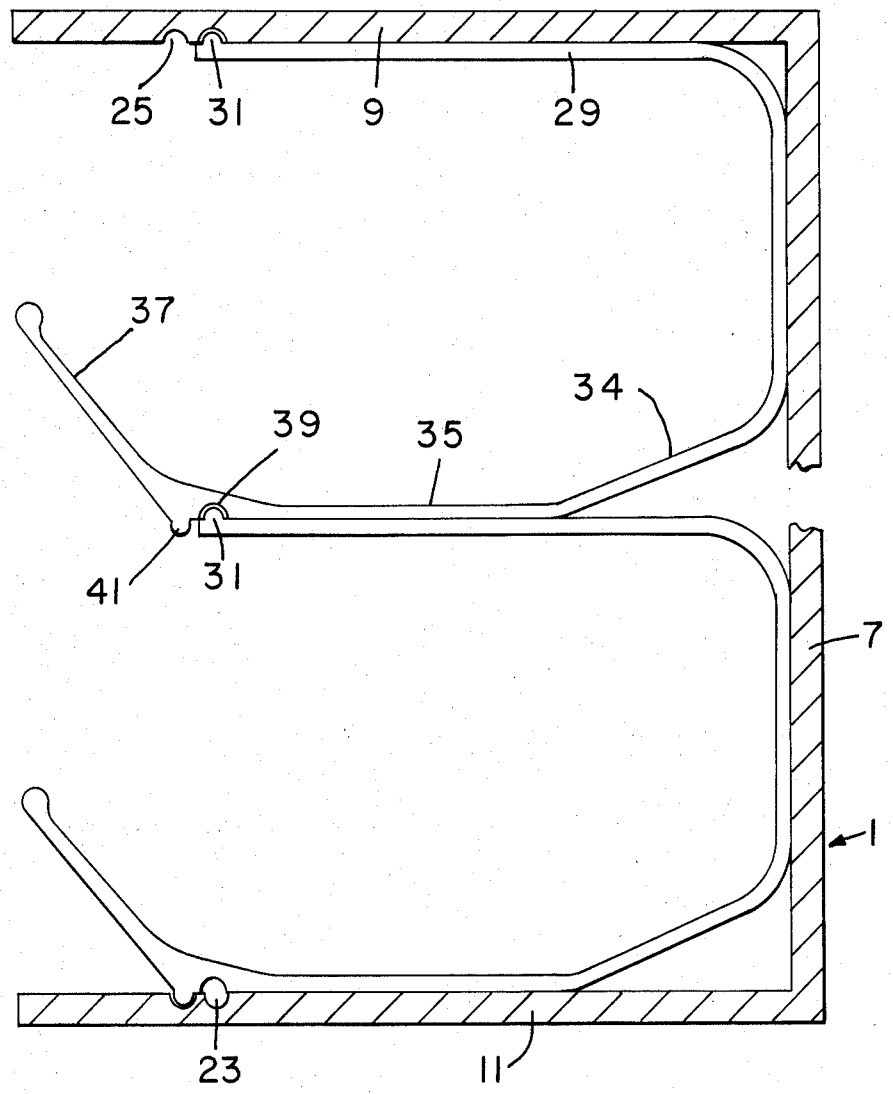
FIG. 5 is a cross sectional view of the kit box of FIG. 1 showing the bins in position.

Referring now to FIGS. 4 and 5, the assembly of the kit box in accordance with the present invention will now be described. Initially, the divider 3 is disposed in the housing 1 along the grooves 17 and 19 with the retainer flange 27 entering the groove 21 in the wall 7 as shown in FIG. 2. The retainer flange 27 will be disposed against the rear wall 7. The first bin 5 is then entered to the left of the divider 3 so that the lower locking tab 41 fits into the forwardmost groove 23 in the bottom 11 of the housing 1. The rear wall portion 33 of the bin 5 will rest against the retainer flange 27 to aid insecuring the divider 3 in the housing in the manner described hereinabove. A further bin 5 is now disposed in the housing 1 to the left of the divider 3 whereby it rests atop the first bin 3 already positioned in the housing. The two bins are arranged so that the upper locking tab 31 of the lower bin rests in the locking groove 39 of the upper bin in the manner shown in FIG. 5. This provides a rigid fit between the two adjacent bins 5 and also provides additional force on the retainer flange 27 as described hereinabove. Bins 5 will be entered one atop the other in the manner described hereinabove until the entire space to the left of the divider is filled with bins in the manner shown in FIGS. 1 and 5. The housing portion to the right of the divider 3 is then filled with bins in the same manner. As can be seen, the topmost bin 5 will have its upper locking tab disposed in the rearmost groove 25 in the top wall 9 of the housing 1. Due to the resiliency of each of the walls of the bins 5, there will be a compressive force from bin to bin. It can therefore be seen that the bins will be locked into position due to the compressive force from bin to bin as well as the fact that each bin is locked to the bin above and below and/or to the housing itself.

It is apparent that the kitting box in accordance with the present invention has all of the desirable features required by an assembly operator as described hereinabove and is also easily assembled and easily manufactured since the bins are all of identical shape. It is also apparent that the bins can be formed as shown in FIG. 3 so that there is a tilt from the rear of the bin toward the front whereby parts within the bin will have a tendency to move toward the front of the bin for easy accessibility. The gripping surface on the inside of the bin front provides further ergonometric advantage. Also, the relatively expensive conductive material is used in minimal amounts due to the use of the housing and divider walls as inner and outer bulkheads. It is also apparent that the empty housing without bins therein is usable as a module tray or for any other application to which its size is appropriate.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A kit box which includes:

(a) an electrostatically protective housing, (b) electrostatically protective flexible bin means removably secured in said housing, said bin means including:

(c) continuous flexible sheet means having a top portion, a rear portion, a front portion and a bottom portion, said top and front portions each having a free edge, said sheet means defining space extending entirely between the free edges of said top and front portions, (d) said top portion including first locking means for removably securing said top portion in said housing, and (e) said bottom portion including means for removably securing said bottom portion in said housing.

2. A kit box as set forth in claim 1 wherein said housing includes a top wall and a bottom wall, said top wall including a first locking member releasably securing said first locking member thereto and said bottom wall including a second locking member releasably securing said second locking member thereto.

3. A kit box as set forth in claim 2 wherein said bottom portion tapers downwardly in a direction from said rear portion to said front portion.

4. A kit box as set forth in claim 3 wherein said housing is in the shape of a rectangular parallelepiped having a rear wall, said housing further including dividing means extending in a plane normal to said rear wall, said bin means disposed on one side of said dividing means.

5. A kit box as set forth in claim 4 wherein said dividing means includes a retainer flange extending normal to said plane of said dividing means and closely adjacent said rear wall, said bin means bearing against said retainer flange to retain said retainer flange in said housing.

6. A kit box as set forth in claim 4 wherein the interior of the front of said continuous flexible sheet is concave to provide a gripping surface.

7. A kit box as set forth in claim 2 wherein said housing is in the shape of a rectangular parallelepiped having a rear wall, said housing further including dividing means extending in a plane normal to said rear wall, said bin means disposed on one side of said dividing means.

8. A kit box as set forth in claim 7 wherein said dividing means includes a retainer flange extending normal to said plane of said dividing means and closely adjacent said rear wall, said bin means bearing against said retainer flange to retain said retainer flange in said housing.

9. A kit box as set forth in claim 8 wherein the interior of the front of said continuous flexible sheet is concave to provide a gripping surface.

10. A kit box as set forth in claim 7 wherein the interior of the front of said continuous flexible sheet is concave to provide a gripping surface.

11. A kit box as set forth in claim 1 wherein said bottom portion tapers downwardly in a direction from said rear portion to said front portion.

12. A kit box as set forth in claim 11 wherein said housing is in the shape of a rectangular parallelepiped having a rear wall, said housing further including dividing means extending in a plane normal to said rear wall, said bin means disposed on one side of said dividing means.

13. A kit box as set forth in claim 12 wherein said dividing means includes a retainer flange extending normal to said plane of said dividing means and closely adjacent said rear wall, said bin means bearing against said retainer flange to retain said retainer flange in said housing.

14. A kit box as set forth in claim 12 wherein the interior of the front of said continuous flexible sheet is concave to provide a gripping surface.

15. A kit box as set forth in claim 1 wherein said housing is in the shape of a rectangular parallelepiped having a rear wall, said housing further including dividing means extending in a plane normal to said rear wall, said bin means disposed on one side of said dividing means.

16. A kit box as set forth in claim 15 wherein said dividing means includes a retainer flange extending normal to said plane of said dividing means and closely adjacent said rear wall, said bin means bearing against said retainer flange to retain said retainer flange in said housing.

17. A kit box as set forth in claim 1 wherein the interior of the front of said continuous flexible sheet is concave to provide a gripping surface.

18. A kit box which includes:

(a) an electrostatically protective housing, and (b) plural electrostatically protective flexible bins removably secured in said housing, each said bin including:

(c) a continuous flexible sheet having a top portion, a rear portion, a front portion and a bottom portion, said top and front portions each having a free edge, said sheet means defining space extending entirely between the free edges of said top and front portions, (d) said top portion of the topmost of said bins being removably secured to the top of said housing, (e) the bottom portion of the bottommost of said bins being removably secured to the bottom of said housing, (f) the remaining top and bottom portions of said bins being removably secured to the adjacent portion of the adjacent bin, (g) said top and bottom portions of each of said bins being in a state of compression relative to each other and said housing.

19. A kit box as set forth in claim 18 wherein said bottom portion tapers downwardly in a direction from said rear portion to said front portion.

20. A kit box as set forth in claim 18 wherein the interior of the front of said continuous flexible sheet is concave to provide a gripping surface.

* * * * *